US005907918A

United States Patent [19]

Langevin et al.

[11] Patent Number: 5,907,918

[45] Date of Patent: Jun. 1, 1999

[54] RIFLE BUTTSTOCK

[75] Inventors: Kevin R Langevin, Camden; Gary A Sniezak, Columbia, both of S.C.

[73] Assignee: FN Manufacturing Inc., Columbia, S.C.

[21] Appl. No.: 08/984,966

[22] Filed: Dec. 4, 1997

[51] Int. Cl.[6] ..... F41C 23/00

[52] U.S. Cl. ..... 42/71.01; 42/85; 42/74

[58] Field of Search ..... 42/71.01, 85, 74

[56] References Cited

U.S. PATENT DOCUMENTS

| | | | |
|---|---|---|---|
| 1,734,852 | 11/1929 | Frampton et al. | 42/87 |
| 2,292,351 | 8/1942 | Carpenter et al. | 42/71.01 |
| 2,924,904 | 2/1960 | Amsler | 42/74 |
| 3,011,283 | 12/1961 | Lunn et al. | 42/71.01 |
| 3,023,527 | 3/1962 | Leek et al. | 42/71 |
| 3,665,632 | 5/1972 | Ford | 42/71 R |
| 4,290,220 | 9/1981 | Ruger | 42/75 D |
| 4,512,101 | 4/1985 | Waterman, Jr. | 42/71 R |
| 4,555,051 | 11/1985 | Johnson | 224/150 |
| 4,654,993 | 4/1987 | Atchisson | 42/71.01 |
| 4,663,876 | 5/1987 | Reaume | 42/71.01 |
| 4,674,216 | 6/1987 | Ruger et al. | 42/71.01 |
| 4,691,852 | 9/1987 | Phelps | 224/150 |
| 4,823,998 | 4/1989 | Johnson | 224/150 |
| 5,519,957 | 5/1996 | Iannetta | 42/74 |

*Primary Examiner*—Charles T. Jordan
*Assistant Examiner*—Meena Chelliah
*Attorney, Agent, or Firm*—Michael A Mann; Nexsen Pruet Jacobs & Pollard LLP

[57] ABSTRACT

A buttstock formed with a single piece of molded synthetic materials and contains two slots so that the rifle may be carried using a sling in multiple positions. The buttstock is designed to have the same size and occupy the same exterior envelop as a standard M-16 rifle buttstock but with far fewer parts and lower weight but without compromising strength. The buttstock comprises a buttplate, a shoulder, and a flange all held in spaced relationship with and integral with a panel. Two slots are formed in the panel near the buttstock, one parallel to the shoulder and the other parallel to the flange. Each slot is dimensioned to receive a sling.

17 Claims, 2 Drawing Sheets

FIG. 1
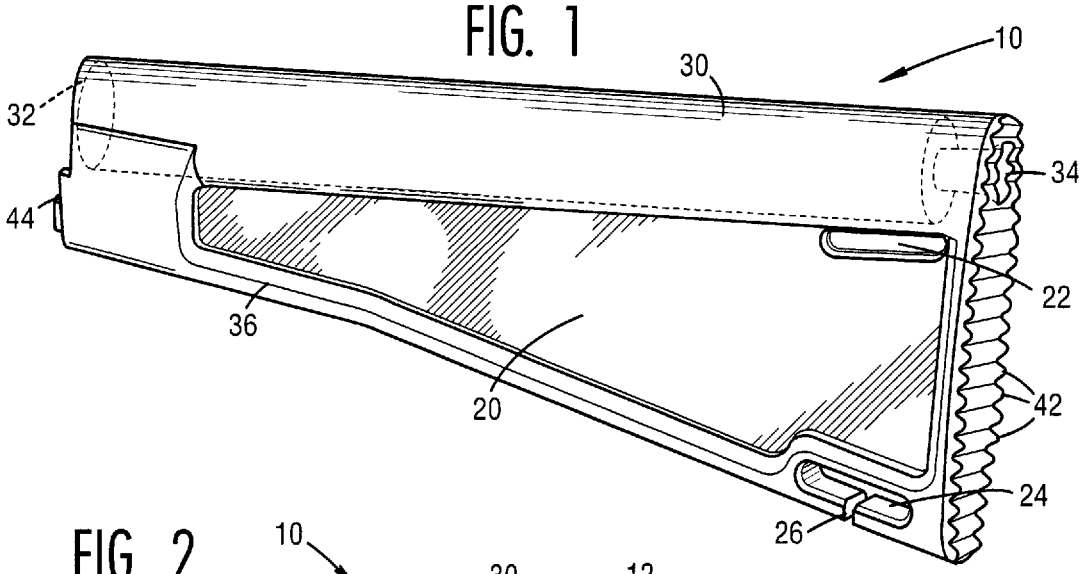
FIG. 2
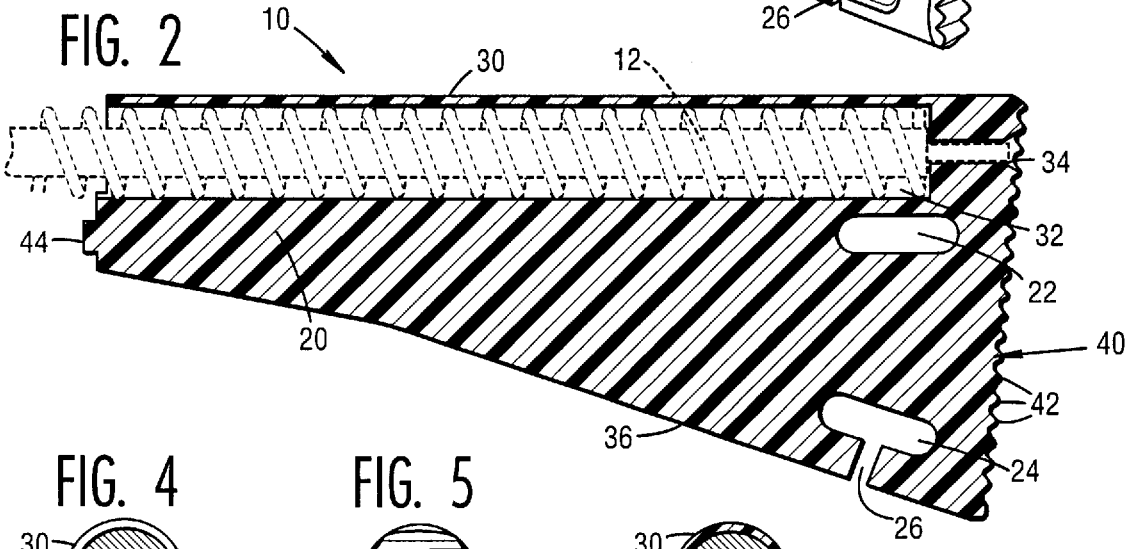
FIG. 4
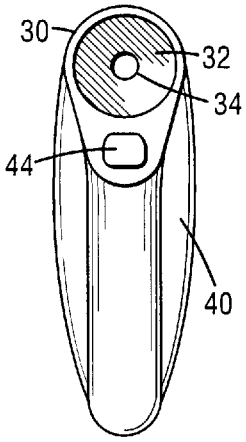
FIG. 5
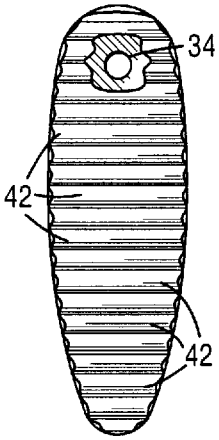
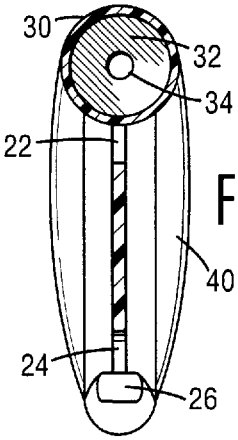
FIG. 6
FIG. 3
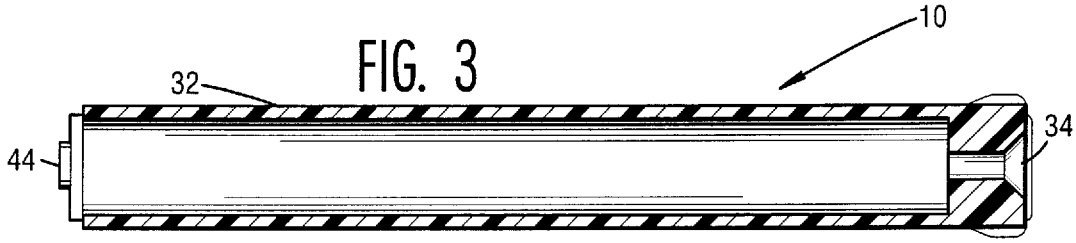

RIFLE BUTTSTOCK

FIELD OF THE INVENTION

The present invention relates to a buttstock for a rifle.

BACKGROUND OF THE INVENTION

Rifle improvements over the years have increased the effectiveness of hunters and infantry soldiers alike. The buttstock of the rifle has also been subject to improvements. However, while new buttstock designs have resulted in greater functionality, new designs have not necessarily decreased cost or simplified manufacturing or reduced the weight of the rifle.

For example, the buttstock for the M-16, which has undergone over thirty years of improvements, currently comprises fourteen separate parts that must be manufactured to tolerances and assembled. Moreover, taking into account the vast distances over which the rifles must be carried, the weight of the buttstock is not off limits as a candidate for reduction of weight.

Adding to the complexity, various attachments have been developed that increase the functionality of the buttstock by allowing the rifle to be carried in both a horizontal "ready" position and conventional carrying position. For purposes of discussion, the term "conventional carrying position" refers to a rifle carrying position where the rifle is placed over the carrier's shoulder in a more or less vertical position; in contrast, the term "horizontal ready" position refers to a rifle carrying position where the rifle is oriented in a horizontal direction.

Thus, there exists a need for a simply designed buttstock that reduces the total number of parts, overall weight but preserves the functionality of the stock.

SUMMARY OF THE INVENTION

According to its major aspects and briefly stated, the present invention is a buttstock for a rifle. The buttstock is molded from synthetic materials and contains two integrated slots for a sling to enable the rifle to be carried in multiple orientations. The improved stock, however, fits in the same envelope as a current M-16 rifle stock. The buttstock is molded to have a triangular-shaped channel formed in the center. Surrounding the channel is a shoulder on the top of the buttstock and a shoulder on the bottom with a butt plate at the end of the buttstock. The shoulder on the top of the buttstock encloses a borehole to hold a recoiling spring. Formed in the buttstock is a pair of slots so that the rifle can be carried in any one of multiple positions. On the buttstock is a plurality of horizontal teeth that serve as a grip to position the rifle while firing.

A major feature of the present invention is having the buttstock formed from a single molded piece of plastic. Largely because of this feature, but not entirely, the number of parts is reduced from fourteen to two, thus reducing the cost of manufacturing substantially without diminishing strength or performance. Additionally, the weight of the buttstock is significantly reduced.

Multiple slots in the present buttstock allow the user of the rifle flexibility in how the sling is attached and the modes of carrying the rifle.

Other features and advantages will be apparent to those skilled in the art from a careful reading of the detailed description of a preferred embodiment accompanied by the following drawings.

BRIEF DESCRIPTION OF THE DRAWINGS

In the drawings,

FIG. 1 is a perspective view of a buttstock, according to a preferred embodiment of the present invention;

FIG. 2 is a cross-sectional side view of a buttstock with the recoiling spring shown in ghost, according to a preferred embodiment of the present invention;

FIG. 3 is a cross-sectional top view of a buttstock according to a preferred embodiment of the present invention;

FIG. 4 is a front view of a buttstock, according to a preferred embodiment of the present invention;

FIG. 5 is a back view of a buttstock, according to a preferred embodiment of the present invention; and FIG. 6 is a cross-sectional front view of a buttstock, according to a preferred embodiment of the present invention.

DETAILED DESCRIPTION OF A PREFERRED EMBODIMENT

Figure 7:
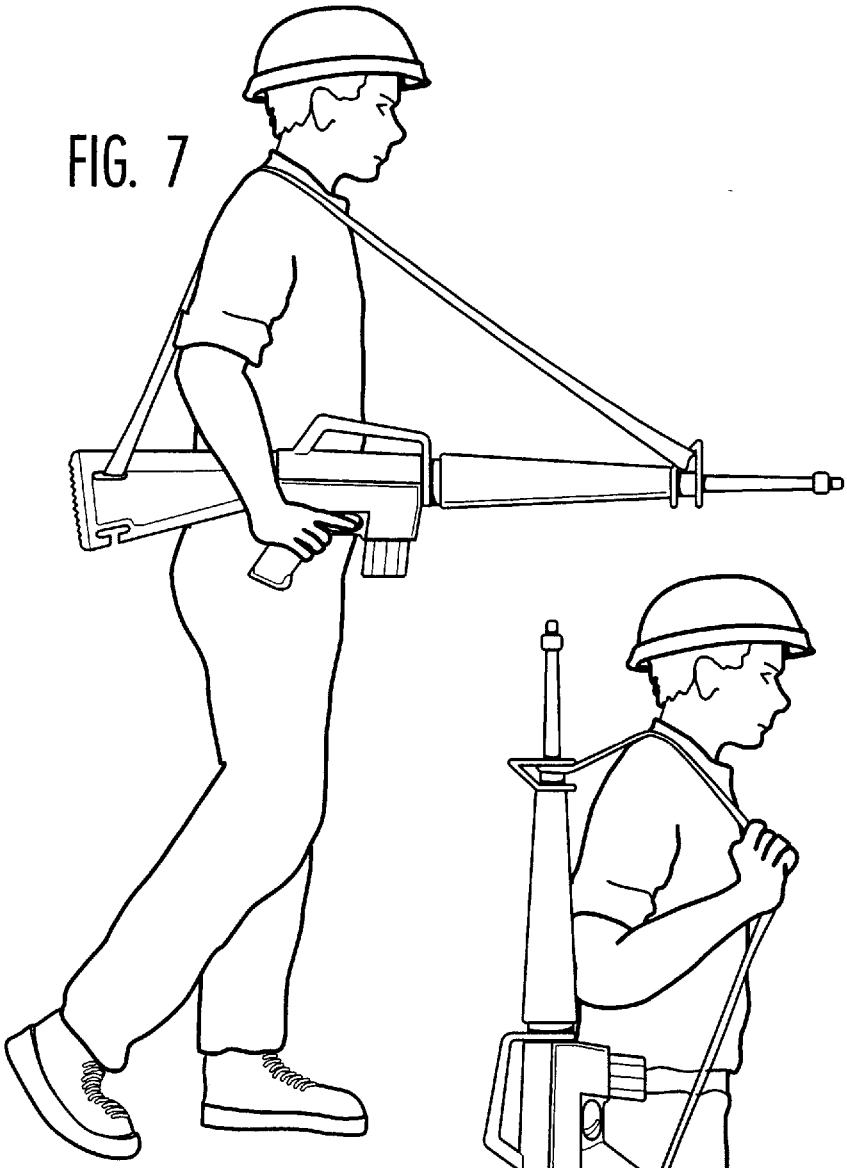
FIG. 7 is a perspective view of the buttstock in use carried in the conventional position, according to a preferred embodiment of the present invention.

The present invention is a buttstock for use with rifles. Although the buttstock could be used with various rifles, in the preferred embodiment, the buttstock is designed for an M-16 rifle. The present buttstock in a preferred embodiment is shown in the drawings 1–8 and generally indicated by reference number 10. For purposes of referring to the drawings, the front side of buttstock 10 is the side having a surface 44 that is configured to engage the receiver of the rifle, and the back side is the end with a plurality of teeth 42. The top of buttstock 10 is the side having a shoulder 30 and that houses a recoiling spring shown in phantom lines, while the bottom is the side having a slot 24.

The overall size and shape of buttstock 10 has preferably the same "envelope" as an M-16 rifle; that is, its outer dimensions of buttstock 10 are no greater than those of a standard M-16 buttstock. Although different sections of the buttstock 10 will be referred to in the drawings, the buttstock 10 comprises a single molded piece. The entire buttstock 10 may be molded from a high-impact plastic or any other material of high strength that may be molded, but is preferable made of nylon sold under the trademark of Zytel ST-801.

Toward the back end of buttstock 10 is a buttplate 40. The buttplate 40 is oval in shape, as can be seen best in FIG. 5. Protruding from the buttplate 40 are a plurality of teeth 42 formed on the buttplate 40 to run from side to side so that, when the two sides of the buttplate are molded, the teeth can be molded at the same time and the two halves of the mold can be easily separated. Teeth 42 provide friction for gripping and for positioning in engagement with the shoulder of the user in order to reduce slippage when the rifle is fired. Although the exact number and dimensions of teeth 42 are not critical, in the preferred embodiment teeth 42 are approximately 0.1 inches from base to base and have an apex at a 90° angle. Near the top of buttplate 40 is a plug 34 that is positioned near the center of the bore 32 for the recoiling spring (shown in phantom lines in FIG. 2). Plug 34 is connected to a rod (also shown in phantom lines in FIG. 2) that allows attachment to the receiver of the rifle. Preferably, plug 34 is attached to the receiver using a common screwdriver.

At the top and bottom of buttplate 40 is shoulder 30 for housing a recoiling spring, and a flange 36, respectively.

Shoulder 30 and flange 36 converge toward the front of the buttstock 10 as seen in FIG. 1. Shoulder 30 of buttstock 10 is formed to define a cylindrical cavity or bore 32 extending along the top of buttstock 10 from the front end to buttplate 40 as seen in FIG. 3. Bore 32 is dimensioned to house a recoiling spring as seen in FIG. 2. Along the bottom of buttstock 10 from the front end to buttplate 40 is flange 36. Flange 36 should be of suitable width to provide adequate support for buttstock 10.

Flange 36 is angled up toward shoulder 30 throughout its full length. However, flange 36 is not straight. A portion of the flange near the end of the buttstock is sloped toward the shoulder at a greater angle than the portion nearer the front of buttstock 10, as seen in FIG. 1. Although the exact angle at which flange 36 is directed toward shoulder 30 and the point at which that angle flattens is not critical, in the preferred embodiment, the angle of the flange 36 with respect to shoulder 30 and point of change in that angle conforms with the envelope of a M-16.

Between shoulder 30, buttplate 40 and flange 36 is a triangular-shaped recessed plate 20. Plate 20 completely fills the void between shoulder 30, buttplate 40 and flange 36, but is not as thick as shoulder 30 or flange 36, as can be seen in the cross sectional view shown in FIG. 6. Although the exact thickness is not critical for the present invention, in the preferred embodiment, the plate 20 only as thick as needed to provide structural strength.

Figure 8:
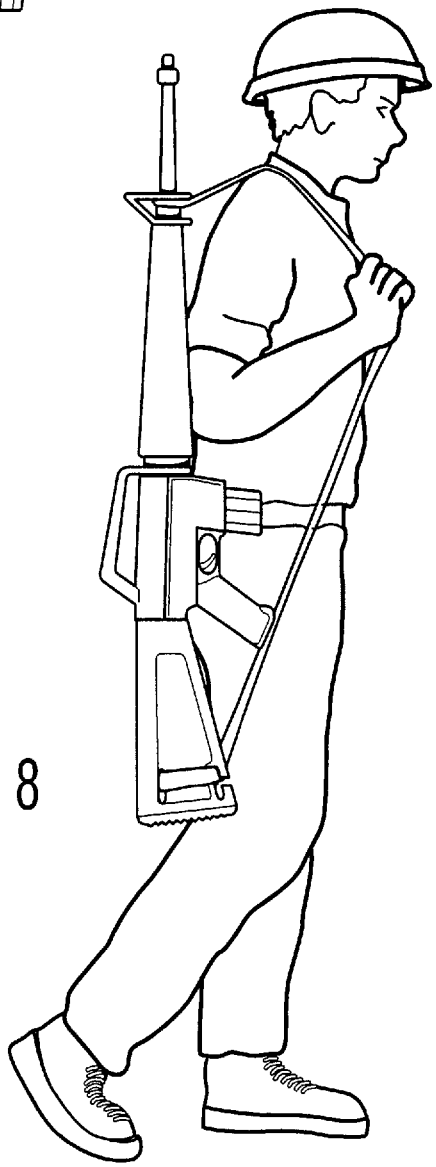
FIG. 8 is a perspective view of the buttstock in use carried in the horizontal ready position, according to a preferred embodiment of the present invention.

Buttstock 10 also contains means for carrying the rifle in various combat positions. For purposes of discussion, the term "conventional carrying position", as illustrated in FIG. 7, refers to a carrying position where the rifle is nearly vertical and the front or barrel end of the sling is placed over the shoulder of the carrier. In contrast, the term "horizontal ready" position refers to a way of carrying a rifle so that the rifle is pointed in a horizontal direction and the middle of the sling is positioned over the shoulder as seen in FIG. 8. According to the present invention, slots to receive a sling so that both the conventional and horizontal ready positions can be used are formed into the buttstock 10 when it is molded. A slot 22, located near the top and back section of the buttstock 10, provides a means for carrying a rifle in the horizontal ready position. Slot 22 is preferably formed to have suitable dimensions to allow attachment of a standard sling. Along flange 36 near buttplate 40, second slot 24 is located. Second slot 24 is parallel to the flange 36 and contains a slit 26 so that a sling could be easily removed from slot 24 by sliding it out of slit 26. Slots 22 and 24 are dimensioned to receive a standard sling.

It will be apparent to those skilled in the art that many modifications and substitutions can be made to the preferred embodiment just described without departing from the spirit and scope of the invention as defined in the appended claims.

What is claimed is:

1. A buttstock comprising a single molded piece integrally formed to define a shoulder, plate, flange and buttplate, said plate holding said shoulder and flange in spaced relation, said buttplate being adjacent to and integral with said shoulder, plate and flange, said shoulder having a cylindrical bore formed therein dimensioned to receive a recoil spring, said plate having a first slot and second slot adapted to receive a sling wherein said first slot is oriented for carrying a rifle in a ready position and said second slot is oriented for carrying said rifle in a conventional carrying position, said buttstock being entirely formed from a plastic material.

2. The buttstock as recited in claim 1, wherein said buttstock is entirely formed from nylon.

3. The buttstock as recited in claim 2, wherein said first slot is parallel to said flange.

4. The buttstock as recited in claim 2, wherein said second slot is parallel to said shoulder.

5. The buttstock as recited in claim 2, wherein said first slot has a slit for receiving said sling.

6. The buttstock as recited in claim 1, wherein said first slot is parallel to said flange.

7. The buttstock as recited in claim 6, wherein said second slot is parallel to said shoulder.

8. The buttstock as recited in claim 6, wherein said first slot has a slit for receiving said sling.

9. The buttstock as recited in claim 1, wherein said second slot is parallel to said shoulder.

10. The buttstock as recited in claim 9, wherein said first slot has a slit for receiving said sling.

11. The buttstock as recited in claim 1, wherein said first slot has a slit for receiving said sling.

12. The buttstock as recited in claim 1, wherein said buttplate carries a plurality of teeth.

13. The buttstock as recited in claim 1, wherein said buttplate carries a plurality of teeth oriented so that said buttstock can be molded by a two-piece mold, each piece molding one side of said buttstock and half of said buttplate.

14. The buttstock as recited in claim 8, wherein said buttstock is made of nylon.

15. A buttstock molded of plastic and having a first slot and second slot adapted to receive a sling wherein said first slot is oriented for carrying a rifle in a ready position and said second slot is oriented for carrying said rifle in a conventional carrying position, said buttstock being entirely formed from a plastic material.

16. A rifle, comprising:

a receiver;

a barrel attached to said receiver;

a firing mechanism attached to said receiver; and a buttstock formed from a single molded piece to define a shoulder, plate, flange and buttplate, said plate holding said shoulder and flange in spaced relation, said buttplate being adjacent to and integral with said shoulder, plate and flange, said shoulder having a cylindrical bore formed therein dimensioned to receive a recoil spring, said plate having a first slot and second slot adapted to receive a sling wherein said first slot is oriented for carrying a rifle in a ready position and said second slot is oriented for carrying said rifle in a conventional carrying position, said buttstock being entirely formed from a plastic material.

17. The buttstock as recited in claim 16, wherein said buttstock is entirely formed from nylon.

* * * * *